US010648160B2

(12) United States Patent
Elkins

(10) Patent No.: US 10,648,160 B2
(45) Date of Patent: May 12, 2020

(54) WORK MACHINE WITH BUCKET MONITORING

(71) Applicant: CNH Industrial America LLC, New Holland, PA (US)

(72) Inventor: Scott A. Elkins, Plainfield, IL (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 15/499,427

(22) Filed: Apr. 27, 2017

(65) Prior Publication Data

US 2018/0313063 A1 Nov. 1, 2018

(51) Int. Cl.

| | |
|---|---|
| ***E02F 9/26*** | (2006.01) |
| ***E02F 3/32*** | (2006.01) |
| ***E02F 3/38*** | (2006.01) |
| ***E02F 3/40*** | (2006.01) |
| ***E02F 9/20*** | (2006.01) |
| ***E02F 3/43*** | (2006.01) |

(Continued)

(52) U.S. Cl.

CPC ..... *E02F 9/264* (2013.01); *E02F 3/32* (2013.01); *E02F 3/38* (2013.01); *E02F 3/401* (2013.01); *E02F 3/435* (2013.01); *E02F 9/2033* (2013.01); *E02F 9/245* (2013.01); *E02F 9/26* (2013.01); *E02F 9/265* (2013.01); *E02F 3/34* (2013.01); *E02F 3/964* (2013.01); *E02F 9/16* (2013.01)

(58) Field of Classification Search

CPC ... E02F 9/264; E02F 9/265; E02F 3/32; E02F 3/401; E02F 3/38; E02F 9/26; E02F 9/2033; E02F 3/34; E02F 9/16; E02F 3/964

USPC ..... 701/50; 700/302; 37/443, 416, 411, 347

See application file for complete search history.

(56) References Cited

U.S. PATENT DOCUMENTS

| | | | |
|---|---|---|---|
| 3,997,071 | A | 12/1976 | Teach |
| 4,604,025 | A | 8/1986 | Hammoud |

(Continued)

FOREIGN PATENT DOCUMENTS

| | | | |
|---|---|---|---|
| EP | 1 835 079 | A1 | 9/2007 |
| WO | 2011/131195 | A1 | 10/2011 |

OTHER PUBLICATIONS

Product description of AGL Laser's EZDig Pro taken from http://www.agl-lasers.com/products/details/ezdig.pro (2 pages).

(Continued)

*Primary Examiner* — Nga X Nguyen

(74) *Attorney, Agent, or Firm* — Peter Zacharias; Patrick Sheldrake

(57) ABSTRACT

A work machine includes: a chassis; a backhoe assembly carried by the chassis, the backhoe assembly including: a boom pivotably linked to the chassis at a boom pivot point; a boom angle sensor associated with the boom pivot point; a stick extendably linked to the boom; a stick extension sensor associated with the stick; a bucket pivotably linked to the stick at a bucket pivot point; and a bucket angle sensor associated with the bucket pivot point. A controller coupled to the boom angle sensor, the stick extension sensor, and the bucket angle sensor is configured to: determine a boom angle of the boom; determine a stick extension of the stick; determine a bucket angle of the bucket; and output a bucket location signal corresponding to a current bucket position and a current bucket orientation, relative to the chassis, based on the determined boom angle, stick extension, and bucket angle.

16 Claims, 11 Drawing Sheets

(51) Int. Cl.

| | |
|---|---|
| ***E02F 9/24*** | (2006.01) |
| *E02F 9/16* | (2006.01) |
| *E02F 3/34* | (2006.01) |
| *E02F 3/96* | (2006.01) |

(56) References Cited

U.S. PATENT DOCUMENTS

| | | | | |
|---|---|---|---|---|
| 4,805,086 | A | 2/1989 | Nielsen et al. | |
| 4,863,337 | A | 9/1989 | Ishiguro et al. | |
| 4,866,641 | A | 9/1989 | Nielsen et al. | |
| 4,964,779 | A | 10/1990 | Sagaser | |
| 5,347,448 | A | 9/1994 | Nam | |
| 5,649,600 | A | 7/1997 | Marsh | |
| 5,748,097 | A * | 5/1998 | Collins | E02F 3/32 340/685 |
| 5,782,018 | A | 7/1998 | Tozawa et al. | |
| 5,826,666 | A | 10/1998 | Tozawa et al. | |
| 5,854,988 | A | 12/1998 | Davidson et al. | |
| 5,933,346 | A | 8/1999 | Brabec et al. | |
| 6,025,686 | A | 2/2000 | Wickert et al. | |
| 6,523,765 | B1 | 2/2003 | Kurenuma et al. | |
| 6,556,946 | B2 | 4/2003 | Sewell | |
| 7,430,983 | B2 | 10/2008 | Hicok et al. | |
| 7,832,126 | B2 | 11/2010 | Koellner et al. | |
| 8,038,380 | B2 | 10/2011 | Opperud | |
| 2002/0084135 | A1* | 7/2002 | Heyne | A01B 63/10 180/321 |
| 2004/0020083 | A1* | 2/2004 | Staub | E02F 9/26 37/348 |
| 2005/0027420 | A1 | 2/2005 | Fujishima et al. | |
| 2008/0263910 | A1 | 10/2008 | Schoenmaker et al. | |
| 2010/0215469 | A1 | 8/2010 | Trifunovic | |
| 2011/0029279 | A1 | 2/2011 | McAree et al. | |
| 2011/0153167 | A1 | 6/2011 | Kahle | |
| 2013/0197737 | A1* | 8/2013 | Malayappalayam Shanmugam | E21F 17/18 701/29.1 |

OTHER PUBLICATIONS

Extended European Search Report for EP18169542.0, dated Aug. 22, 2018 (7 pages).

* cited by examiner

WORK MACHINE WITH BUCKET MONITORING

FIELD OF THE INVENTION

The present invention relates to work machines, and, more particularly, to work machines equipped with buckets.

BACKGROUND OF THE INVENTION

In the heavy equipment industry, many types of work machines are known which include buckets used to move volumes of material from one location to another. One such type of work machine is known as a tractor/loader/backhoe, often referred to simply as a "TLB," which—as its name suggests—includes a tractor carrying a loader at a front of the tractor and a backhoe at a rear of the tractor. TLBs are popular material movers in various industries due to the versatility that is offered by having both a loader and a backhoe.

Typically, the backhoe of the TLB has a boom at one end which is pivotably attached to the tractor, a bucket at the other end of the backhoe which is pivotably independently of the boom, and a stick connected to the boom at one end and the bucket at the other end. Such an arrangement allows for many possible positions and orientations of the bucket at the end of the backhoe in order to move material. Optionally, the stick may be pivotably and/or extendably connected to the boom to allow the bucket to extend further away from tractor.

One particular problem with backhoes of TLBs occurs when the bucket is positioned within a hole formed in a surface. Due to the tractor resting on the surface into which the hole is formed, the operator may lose a line of sight of the bucket when the bucket is sufficiently deep in the hole. Further, even assuming the operator has an unobstructed view of the bucket, it is difficult for an operator, inexperienced or not, to gauge the depth of the bucket's position within the hole. When digging holes which are adjacent to underground utility pipes, lines and conduits, for example, digging the hole incorrectly not only poses a significant safety risk to the operator and work machine, but could also result in a significant utility service disruption if the bucket damages a utility pipe, line, and/or conduit while digging the hole.

To address this problem, at least one system has been developed to visualize the location of the bucket during operation. The system, known as the EZDig Pro commercially produced and sold by AGL Lasers, has multiple sensors mounted to the backhoe of a TLB wirelessly connected to a display unit which can be placed in the operator cab of the TLB. Following a calibration which tracks movement of the sensors relative to a laser level and the display unit, the EZDig Pro purports to visualize the location and orientation of the bucket based on approximations of the bucket movement characteristics as the sensors move relative to each other. While the EZDig Pro claims to be effective, the extensive calibration process is inconvenient for an operator and, if performed incorrectly, will produce inaccurate approximations of the bucket location and orientations. Further, the EZDig Pro does not integrate with the other components of the work machine, which limits the functional possibilities of the EZDig Pro.

What is needed in the art is a way to consistently and accurately monitor the location and orientation of a work machine bucket.

SUMMARY OF THE INVENTION

In accordance with an aspect of the present invention, there is provided a work machine with a controller which outputs a bucket location signal corresponding to a current bucket position and a current bucket orientation based on a determined boom angle, stick extension, and bucket angle.

In accordance with another aspect of the present invention, there is provided a work machine including: a chassis; a backhoe assembly carried by the chassis, the backhoe assembly including: a boom pivotably linked to the chassis at a boom pivot point; a boom angle sensor associated with the boom pivot point; a stick extendably linked to the boom; a stick extension sensor associated with the stick; a bucket pivotably linked to the stick at a bucket pivot point; and a bucket angle sensor associated with the bucket pivot point; and a controller coupled to the boom angle sensor, the stick extension sensor, and the bucket angle sensor. The controller is configured to: determine a boom angle of the boom; determine a stick extension of the stick; determine a bucket angle of the bucket; and output a bucket location signal corresponding to a current bucket position and a current bucket orientation, relative to the chassis, based on the determined boom angle, stick extension, and bucket angle.

In accordance with yet another aspect of the present invention, there is provided a method of locating a bucket of a work machine including a chassis, including: determining a boom angle of a boom pivotably linked to the chassis at a boom pivot point based on at least one signal from a boom angle sensor associated with the boom pivot point; determining a stick extension of a stick extendably linked to the boom based on at least one signal from a stick extension sensor associated with the stick; determining a bucket angle of the bucket pivotably linked to the stick at a bucket pivot point based on at least one signal from a bucket angle sensor associated with the bucket pivot point; and outputting a bucket location signal corresponding to a current bucket position and a current bucket orientation, relative to the chassis, based on the determined boom angle, stick extension, and bucket angle.

An advantage of the work machine described herein is that the controller can output the bucket location signal based on actual mechanical readings of the various components of the work machine rather than approximations.

Another advantage of the work machine described herein is that the controller can control other work machine functions based on the current or future bucket position.

Still another advantage of the work machine described herein is that the controller can predict a future bucket location and prevent work machine functions which may cause the bucket to be placed in a location that may cause user damage, machine damage or other types of damage.

BRIEF DESCRIPTION OF THE DRAWINGS

The above-mentioned and other features and advantages of this invention, and the manner of attaining them, will become more apparent and the invention will be better understood by reference to the following description of (an) exemplary embodiment(s) of the invention taken in conjunction with the accompanying drawing(s), wherein:

FIG. 4 is a side view of the work machine shown in FIG. 1 on a sloped ground plane;

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
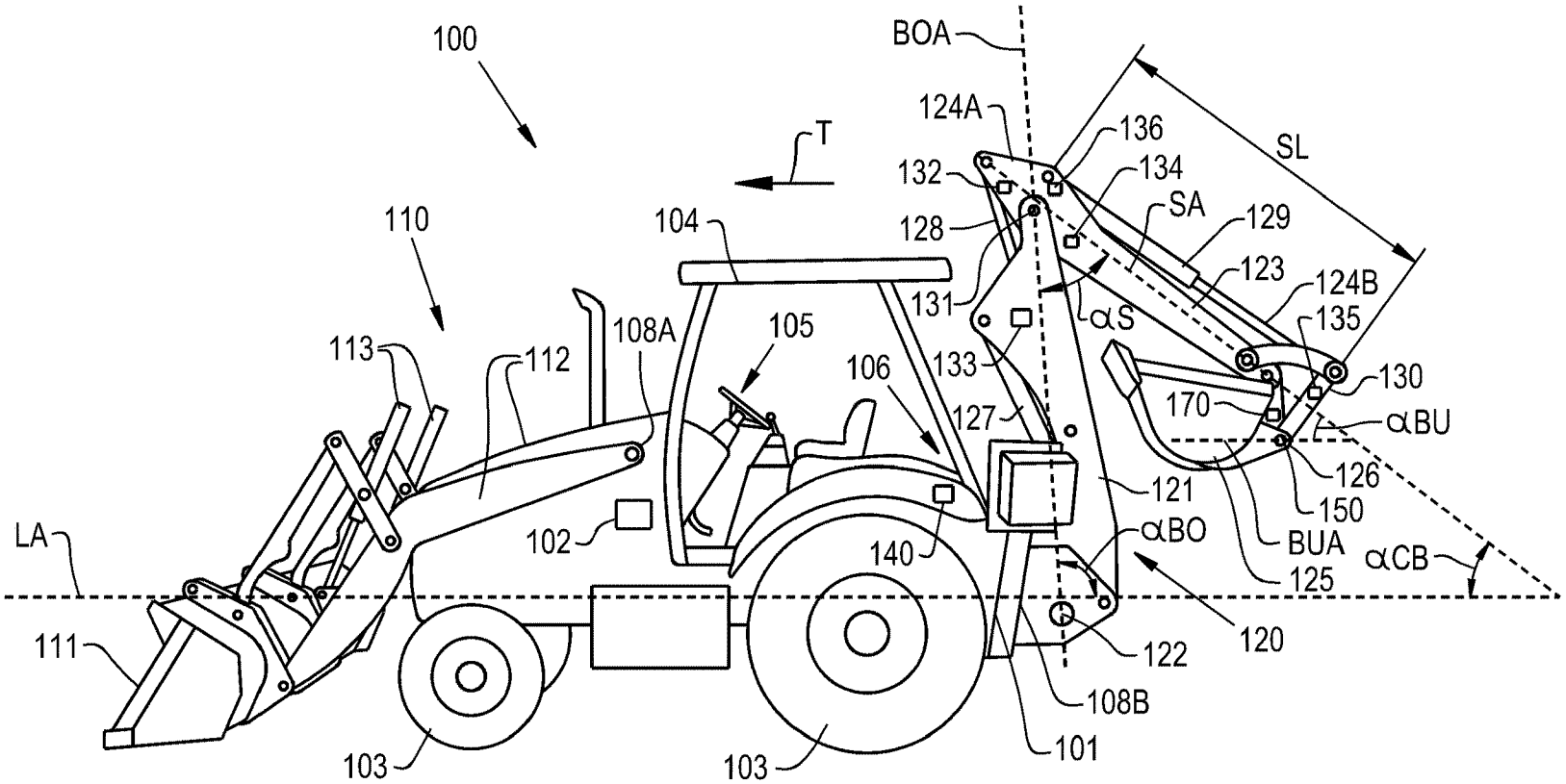
FIG. 1 is a side view of a work vehicle formed in accordance with an exemplary embodiment of the present invention.

Referring now to the drawings, and more particularly to FIG. 1, there is shown an exemplary embodiment of a work machine 100, shown as a tractor/loader/backhoe ("TLB"), which generally includes a chassis 101, a loader assembly 110 carried by the chassis 101, and a backhoe assembly 120 carried by the chassis 101. The TLB 100 can be propelled by a power source 102, such as an internal combustion engine, carried by the chassis 101 and connected to one or more traction members 103, shown as wheels, by a drivetrain (not shown) or other suitable linkage. The TLB 100 can also include a cabin 104 where an operator can manipulate controls 105, 106 of the TLB 100 and which has a display, which is described further herein. The controls 105, 106 can be electrically coupled to a controller 140, as described further herein. While the work machine 100 is shown as a TLB, the work machine 100 can be formed as a variety of other types of work machines without deviating from the scope of the present invention.

As shown, the loader 110 is connected to a front end 108A of the chassis 101 and includes a shovel 111 connected to the chassis 101 by a pair of adjustable shovel arms 112. The shovel 111 can be pivotably connected to the shovel arms 112 to adjust the orientation of the shovel 111 during use by activating one or more shovel actuators 113 connected to the shovel 111 via controls 105. The shovel arms 112 may also be pivotably mounted to the chassis 101, if desired. It should be appreciated that the loader 110 shown in FIG. 1 is exemplary only and many different types of loaders, if included in the work machine 100, may be incorporated according to the present invention.

The backhoe assembly 120, as shown, is connected to a rear end 108B of the chassis 101 and is controlled by the controls 106 in the cabin 104. The backhoe assembly 120 includes a boom 121 pivotably linked to the chassis 101 at a boom pivot point 122, a stick 123 extendably linked to the boom 121 at one end 124A of the stick 123, and a bucket 125 pivotably linked to the stick 123 at a bucket pivot point 126 at an opposite end 124B of the stick 123. In addition to being pivotable about the boom pivot point 122, the boom 121 may also be adjustable laterally, relative to a travel direction T of the work machine 100, which is sometimes referred to as "sideshift." Pivoting of the boom 121 relative to the chassis 101 may be controlled by a boom actuator 127 connected to the chassis 111 and the boom 121, and which may also be electrically coupled to the controller 140 as will be described further herein. Extension of the stick 123 relative to the boom 121 can be controlled by a stick actuator 128 connected to the end 124A of the stick 123 and the boom 121 and also electrically coupled to the controller 140 as will be described further herein. Pivoting of the bucket 125 relative to the stick 123 can be controlled by a bucket actuator 129 connected to the stick 123 and a corresponding linkage 130 of the bucket 125.

As is known, the boom 121 forms a boom angle $\alpha$BO relative to the chassis 101 at the boom pivot point 122 and is adjustable to not only change the orientation of the boom 121, but the stick 123 and bucket 125 carried by the boom 121 as well. As described herein, the boom angle $\alpha$BO is defined between a boom longitudinal axis BOA extending through the boom 121 and a longitudinal axis LA of the chassis 101, which can extend parallel to the travel direction T. Similarly, the stick 123 can define a stick axis SA extending through the stick 123 and forming a stick angle $\alpha$S relative to the boom 121. The stick 123 can be angularly fixed to the boom 121, so the stick angle $\alpha$S does not change, or pivotably linked to the boom 121 at a stick pivot point 131 so that the stick angle $\alpha$S can be adjusted by, for example, activation of a stick angle actuator 132. Finally, the bucket 125 can define a bucket axis BUA extending through the bucket 125 and forming a bucket angle $\alpha$BU relative to the stick 123. It should thus be appreciated that the boom angle $\alpha$BO, stick angle $\alpha$S, and bucket angle $\alpha$BU are inter-related in the sense that pivoting of the boom 121 relative to the chassis 111, for example, will alter the boom angle $\alpha$BO but may not necessarily alter the stick angle $\alpha$S relative to the boom 121 or the bucket angle $\alpha$BU relative to the stick 123. However, because the boom 121 connects the rest of the backhoe assembly 120 to the chassis 101, pivoting of the boom 121 will always necessarily affect the position and/or orientation of the stick 123 and bucket 125 relative to the chassis 101.

In order to track the location of the bucket 125 relative to the chassis 101, the backhoe assembly 120 includes a boom angle sensor 133 associated with the boom pivot point 122 and coupled to the controller 140, a stick extension sensor 134 associated with the stick 123 and coupled to the controller 140, and a bucket angle sensor 135 associated with the bucket pivot point 126 and coupled to the controller 140.

If the stick 123 is pivotably connected to the boom 121, a stick angle sensor 136 may also be associated with the stick pivot point 131 and coupled to the controller 140. As used herein, the sensors 133, 134, 135, 136 are "coupled" to the controller 140 in the sense that respective data signals output by the sensors 133, 134, 135, 136 can be received by the controller 140, via a wired and/or wireless connection, and used to control various functions of the work machine 100, which will be described further herein. The boom angle sensor 133, bucket angle sensor 135, and (optional) stick angle sensor 136 can be any type of rotational angle sensors which are suitable for determining the boom angle αBO, bucket angle αBU, and stick angle αS, respectively, as well as changes in the respective angles αBO, αBU, αS. Many suitable angle sensors are known which may be suitably used for the angle sensors 133, 135, and 136, so the details of their construction are omitted for brevity. The stick extension sensor 134, on the other hand, can be any type of linear sensor which is suitable for determining a current stick length SL of the stick 123, which corresponds to a stick extension relative to the chassis 101. Many suitable linear sensors are known which may be suitably used for the stick extension sensor 134, so the details of their construction are omitted for brevity.

To track the location of the bucket 125, the controller 140 receives signals from the boom angle sensor 133 to determine the boom angle αBO relative to the chassis 101, the stick extension sensor 134 to determine the stick extension relative to the chassis 101 from the current stick length SL, and the bucket angle sensor 135 to determine the bucket angle αBU relative to the stick 123. If the stick 123 is pivotable relative to the boom 121, the controller 140 can also receive signals from the stick angle sensor 136 to determine the stick angle αS relative to the boom 121. Once the controller 140 determines the boom angle αBO relative to the chassis 101, stick extension relative to the chassis 101, bucket angle αBU relative to the stick 123, and (optional) stick angle αS relative to the boom 121, the controller 140 can determine a current bucket position, indicated as reference number 150 in FIG. 1, relative to the chassis 101 and a current bucket orientation, indicated as αCB in FIG. 1, relative to the chassis 101 and output a bucket location signal which corresponds to both the current bucket position 150 and current bucket orientation αCB. As shown in FIG. 1, the current bucket position 150 can be defined at the bucket pivot point 126 since this is the only point, theoretically, where the position of the bucket 125 should change by movement of the bucket 125 only. The controller 140 can determine the current bucket position 150 and current bucket orientation αCB from the boom angle αBO, stick extension, and bucket angle αBU in any suitable manner, such as by calculating the net effect of linear and angular movements of the boom 121, stick 123, and bucket 125 relative to a pre-set zero point of the backhoe assembly 120. The calculations can be performed, for example, according to known geometric relationships between the boom 121, stick 123, and bucket 125. Such calculations can be readily incorporated into the controller 140 by one skilled in the art, and therefore further discussion of possible manners of determining the current bucket position 150 and current bucket orientation αCB are omitted for the sake of brevity. In this sense, the controller 140 can be configured to incorporate pre-loaded geometric dimensions for the boom 121, stick 123, and bucket 125 to allow the controller 140 to accurately determine the current bucket position 150 and current bucket orientation αCB relative to the chassis 101 upon movement of any of the boom 121, stick 123, and/or bucket 125. Alternatively, the controller 140 can also be configured to accept manual input of geometric dimensions for the boom 121, stick 123, and/or bucket 125 by an operator. In another alternative configuration, the boom angle sensor 133 associated with the boom 121, stick extension sensor 134 associated with the stick 123, bucket angle sensor 135 associated with the bucket 125, and/or stick angle sensor 136 associated with the stick 125 can output a geometric dimension signal to the controller 140 which corresponds to the geometric dimensions of the associated element 121, 123, or 125, which can allow for the controller 140 to conveniently and accurately determine the geometric dimensions of the boom 121, stick 123, and bucket 125 in the event of a switch-out.

Figure 2:
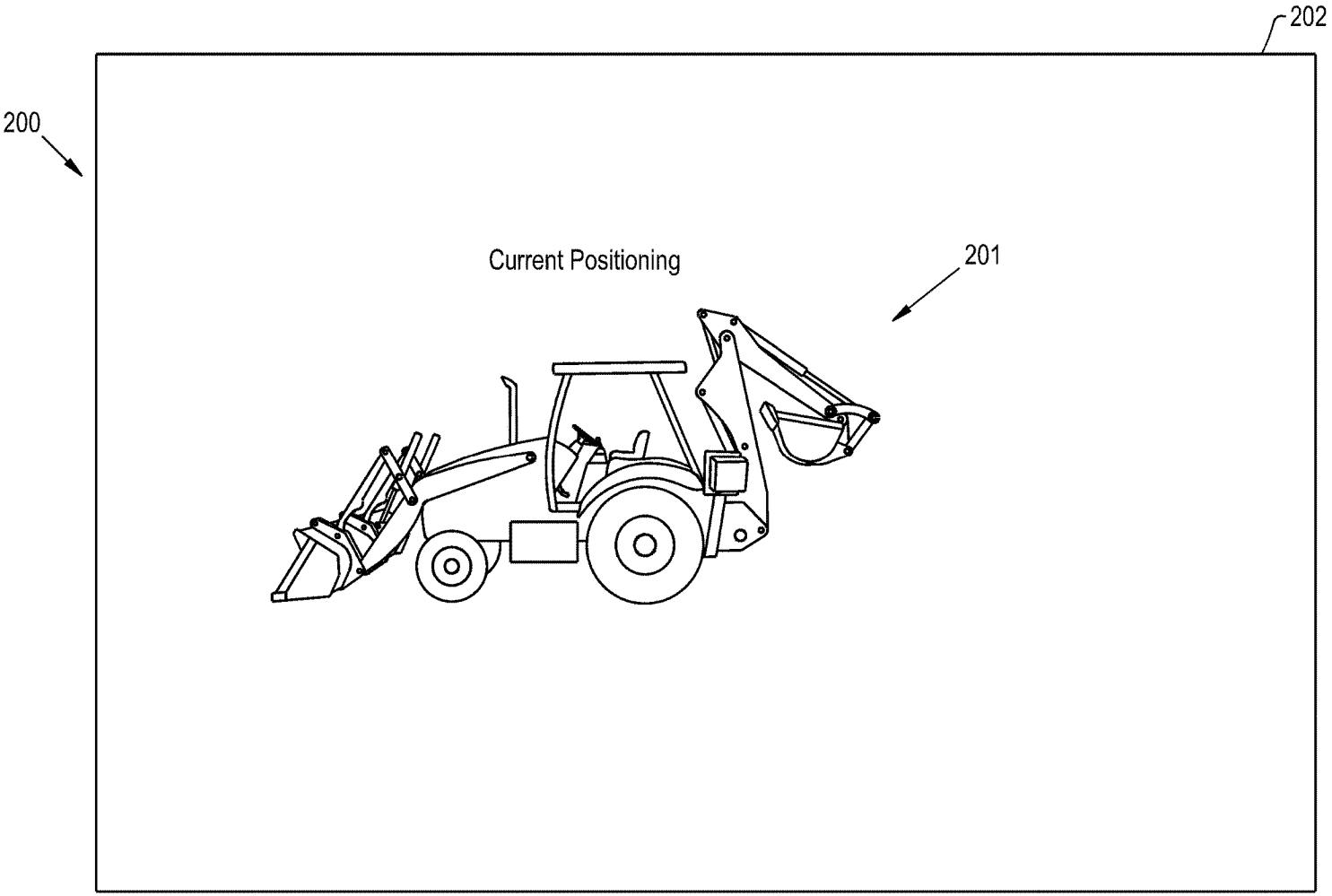
FIG. 2 is a view of an exemplary display showing a visualization of the work machine shown in FIG. 1 in accordance with an exemplary embodiment of the present invention.

Upon determining the current bucket position 150 and current bucket orientation αCB, relative to the chassis 101, and referring now to FIG. 2, the controller 140 can output the bucket location signal corresponding to the current bucket position 150 and current bucket orientation αCB to a display 200 coupled to the controller 140 and placed within the cabin 104 so as to display a visualization 201 of the work machine 100 on a screen 202 of the display 200. The display 200 may be, for example, a monitor or other type of suitable construction for displaying visual graphics. In such an embodiment, the bucket location signal is also a bucket visualization signal in the sense that the bucket location signal output to the display 200 causes the display 200 to produce the visualization 201 on the screen 202 of the display 200. In some embodiments, the display 200 may be a touchscreen display which allows an operator to interact with graphics shown on the screen 202 of the display 200, with the display 200 then outputting corresponding signals to the controller 140, according to known methods and constructions, the significance of which will be described further herein. By displaying the visualization 201 of the work machine 100 on the screen 202 of the display 200, the operator is able to determine the location and orientation of the bucket 125 without needing a line of sight of the bucket 125, which may be obstructed in some cases.

Figure 3:
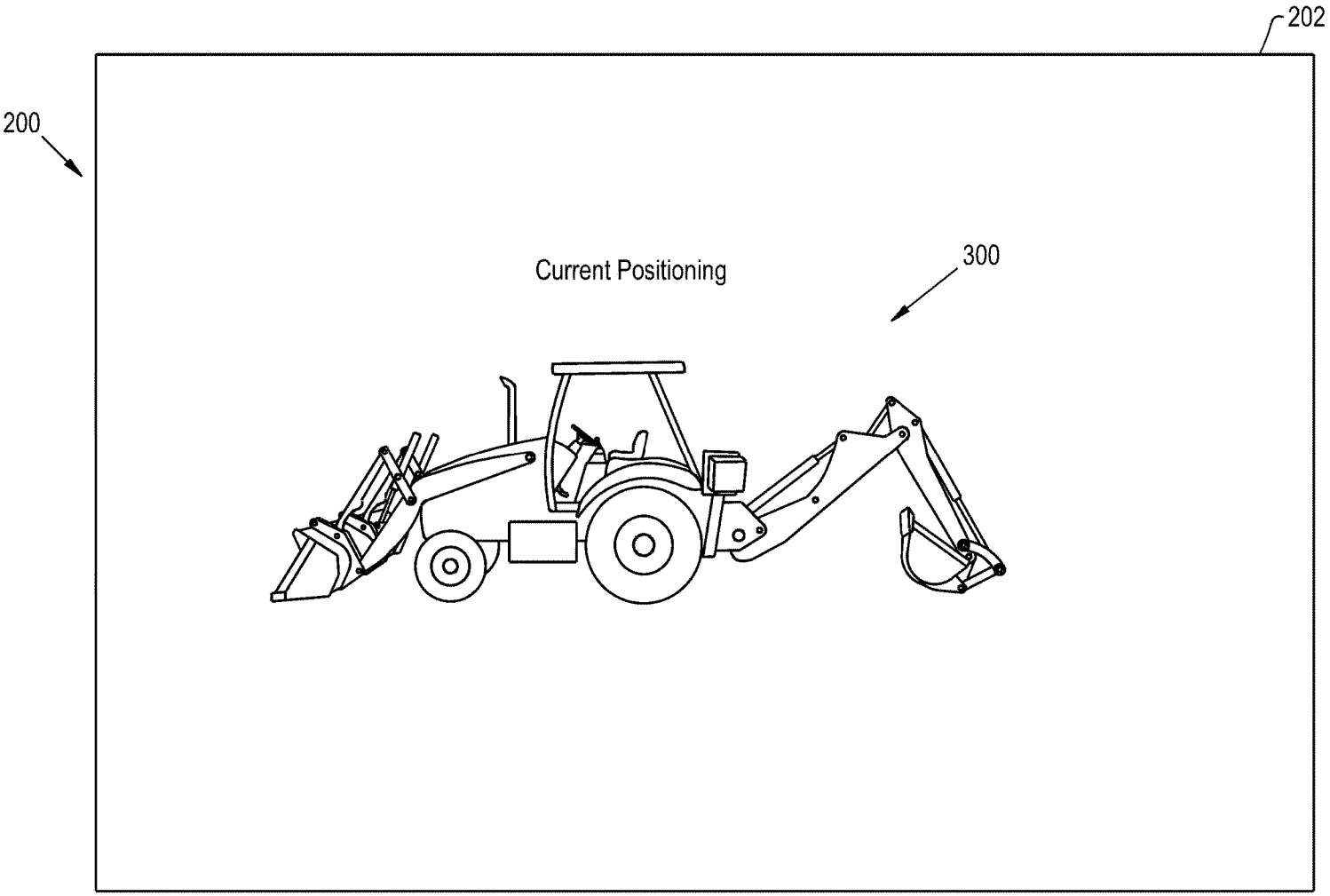
FIG. 3 is a side view of an updated visualization of the work machine shown in FIG. 2 after the work machine has been adjusted.

During operation, the operator can manipulate the backhoe assembly 120 via the controls 106 in the cabin 104. The controls 106, shown as manual levers and switches, can output control signals to the controller 140 which can couple to and selectively activate the boom actuator 127, stick actuator 128, bucket actuator 129, and/or stick angle actuator 132 to pivot the boom 121, extend the stick 123, pivot the bucket 125, and/or pivot the stick 123, respectively, based on the received control signals from the controls 106. By coupling the controls 106 to the controller 140 and the controller to the actuators 127, 128, 129, 132, the operator is able to control respective movements of the boom 121, stick 123, and bucket 125 from within the cabin 104. When the controls 106 are manipulated, the controller 140 can detect control signals from the controls 106 and appropriately activate one or more of the actuators 127, 128, 129, 132, depending upon which of the controls 106 are manipulated and the magnitude of the manipulation. Upon activating one or more of the actuators 127, 128, 129, 132 to alter the location and/or orientation of the boom 121, stick 123, and bucket 125, the controller 140 can query the coupled sensors 133, 134, 135, and/or 136 to re-determine the boom angle αBO, stick extension SL, bucket angle αBU, and stick angle αS and re-determine the current bucket position and current bucket orientation, relative to the chassis 101, and output a visualization update signal to the display 200 so the display 200 produces an updated visualization 300 of the work machine 100, as shown in FIG. 3. By outputting the visualization update signal to the display 200 so the display 200 updates the visualization 300 of the work machine 100 based on movement of the boom 121, stick 123, and/or bucket 125, the controller 140 and display 200 can, in conjunction, keep the operator informed of how the various movements of the backhoe assembly 120 affect the current location and orientation of the bucket 125.

Figure 4:
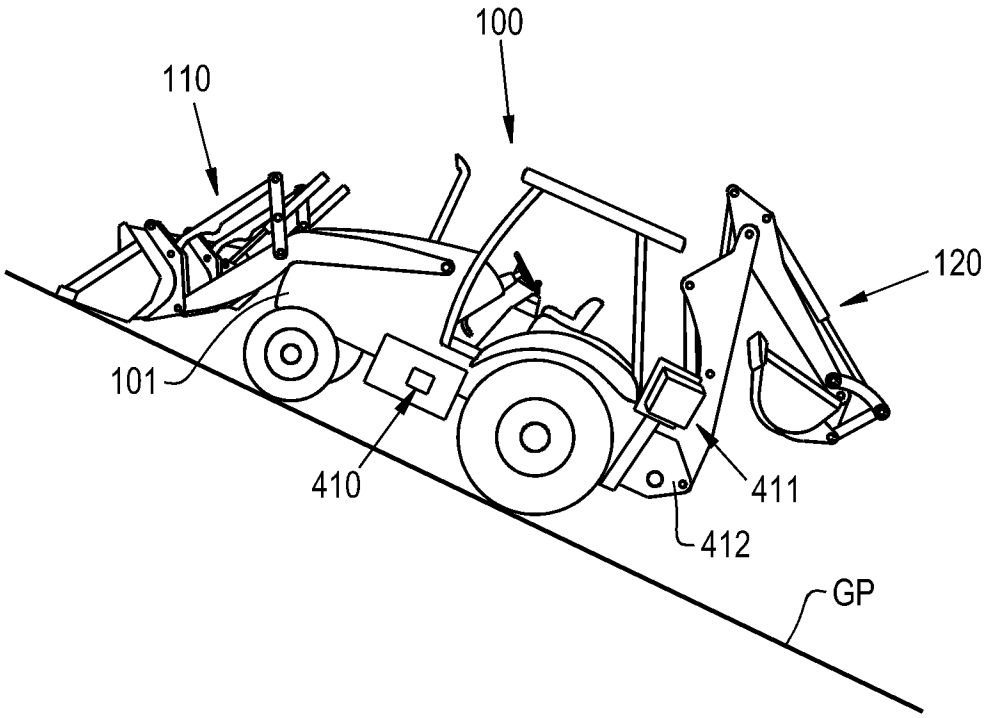
FIG. 4 is a view of the display and associated visualization of the work machine shown in FIG. 3 after the display has been updated.
Figure 5:
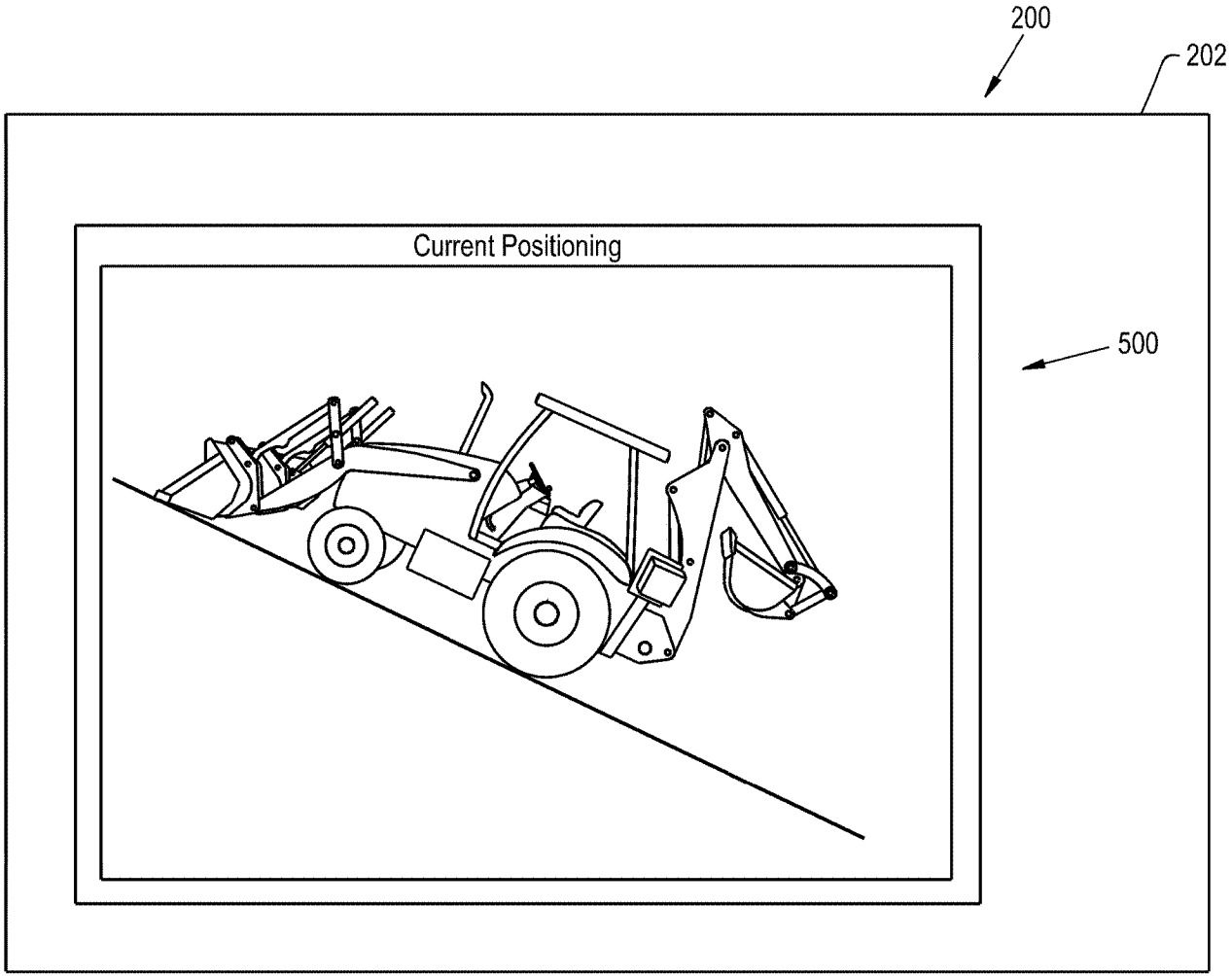
FIG. 5 is a view of an exemplary display showing an updated visualization of the work machine shown in FIG. 4 in accordance with an exemplary embodiment of the present invention.

In certain instances, an operator may wish to not only know the current bucket position 150 and current bucket orientation αCB relative to the chassis 101, but also to a ground plane GP on which the work machine 100 is residing. For example, the operator may drive the work machine 100 from a relatively flat area to a sloped area of a work site without adjusting the backhoe assembly 120, in which case the previous visualization 200 of the work machine 100 showing the work machine 100 on a flat ground plane GP is not particularly helpful. To assist in determining and visualizing the relationship between the work machine 100 and the ground plane GP, and referring now to FIG. 4, the work machine 100 can include one or more tilt sensors 410 which are carried by the chassis 101 and coupled to the controller 140. The tilt sensor(s) 410 can output tilt signals corresponding to a current level of the work machine 100, as is known. By coupling the tilt sensor(s) 410 to the controller 140, the controller 140 can determine where the ground plane GP is relative to the work machine 100 to determine the tilt of the work machine 100 and output signals to the display 200 to accurately depict the orientation of the work machine 100, including the backhoe assembly 120, relative to the ground plane GP. In this sense, the tilt sensor(s) 410 can output a parameter signal to the controller 140 which corresponds to a current operating parameter of the work machine 100 and allows the controller 140 to output a visualization update signal to the display 200 to produce an updated visualization 500, as shown in FIG. 5, which takes into account the slope of the ground plane GP rather than changed positions and/or orientations of the boom 121, stick 123, and/or bucket 125. Alternatively, the parameter signal output to the controller 140 in order to update the visualization on the display 200 can be based on signals from, for example, a backhoe sideshift sensor 411 which determines the lateral sideshift of the backhoe assembly 120 and/or a backhoe rotation sensor 412 which determines the rotational position of the backhoe assembly 120 about the longitudinal axis LA of the work machine 100. It should be appreciated that the previously described parameter sensors 410, 411, 412 are exemplary only, and other parameter sensors could be incorporated in the work machine 100 in accordance with the present invention.

Figure 6:
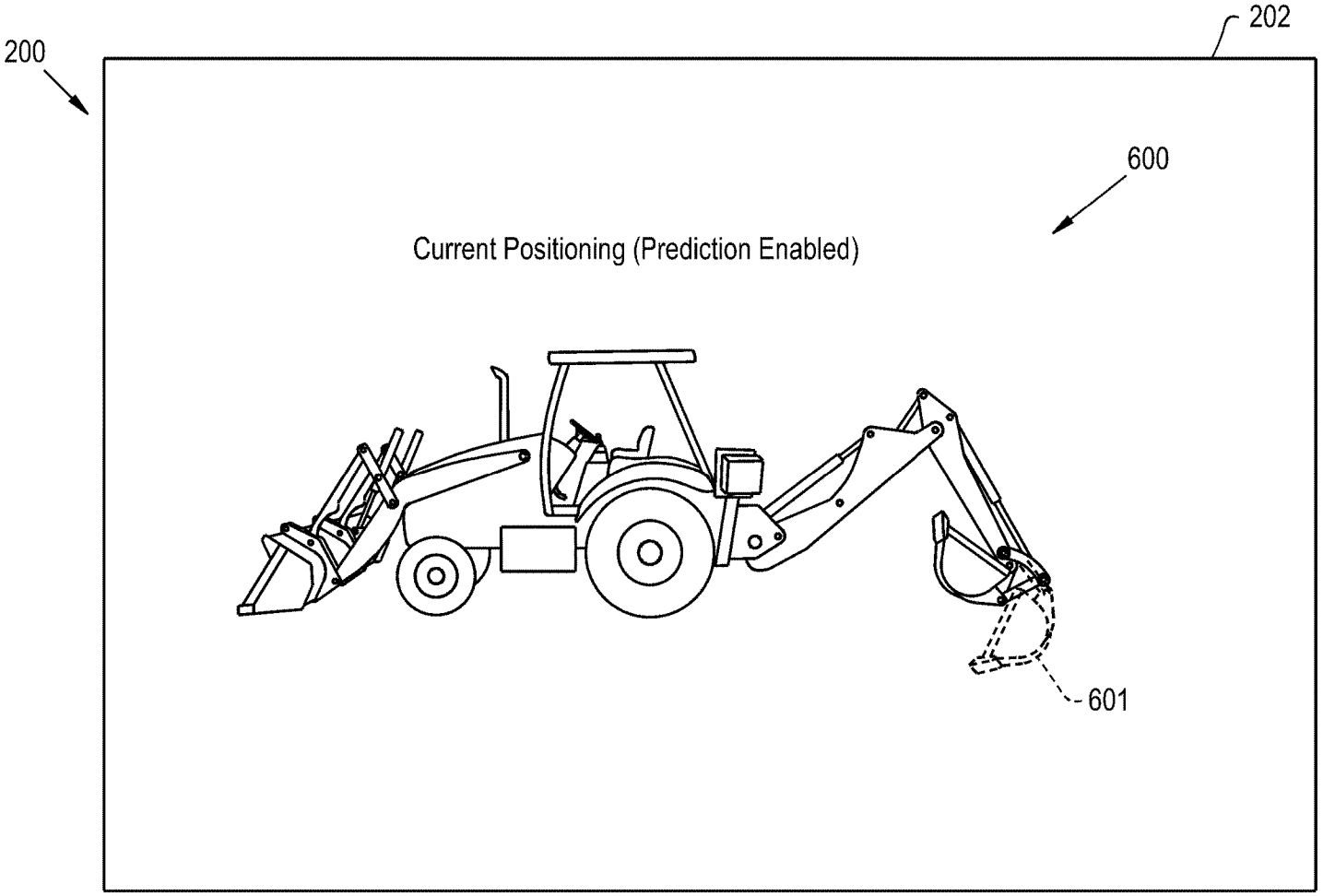
FIG. 6 is a view of an exemplary display showing a predicted location of a bucket of the work machine of FIG. 1 in accordance with an exemplary embodiment of the present invention.

In another exemplary embodiment formed in accordance with the present invention, and referring now to FIG. 6, the controller 140 can be configured to not only output a bucket location signal which corresponds to the current bucket position 150 and a current bucket orientation αCB relative to the chassis 101, but also to predict a future bucket location 601, which is illustrated in dashed lines in FIG. 6, based on selective activation of the boom actuator 127, stick actuator 128, bucket actuator 129, and/or stick angle actuator 132 and display the predicted future bucket location 601 on the screen 202 of the display 200. For example, the controller 140 can be configured to take into account the magnitude of the control signals received from the controls 106 and which actuators 127, 128, 129, and 132 will be selectively activated in order to predict the effect that the selective activation of the actuator(s) 127, 128, 129, 132 will have on the current bucket position and current bucket orientation. The controller 140 can be configured, for example, to predict the future bucket location 601 a desired time interval, such as 0.1-0.5 seconds, in the future and output one or more future bucket visualization signals to the display 200 which will allow the display 200 to create a visualization 600 which shows the predicted future bucket location 601 on the screen 202 so the operator can see how manipulation of the controls 106 will affect the position and orientation of the bucket 125.

Figure 7:
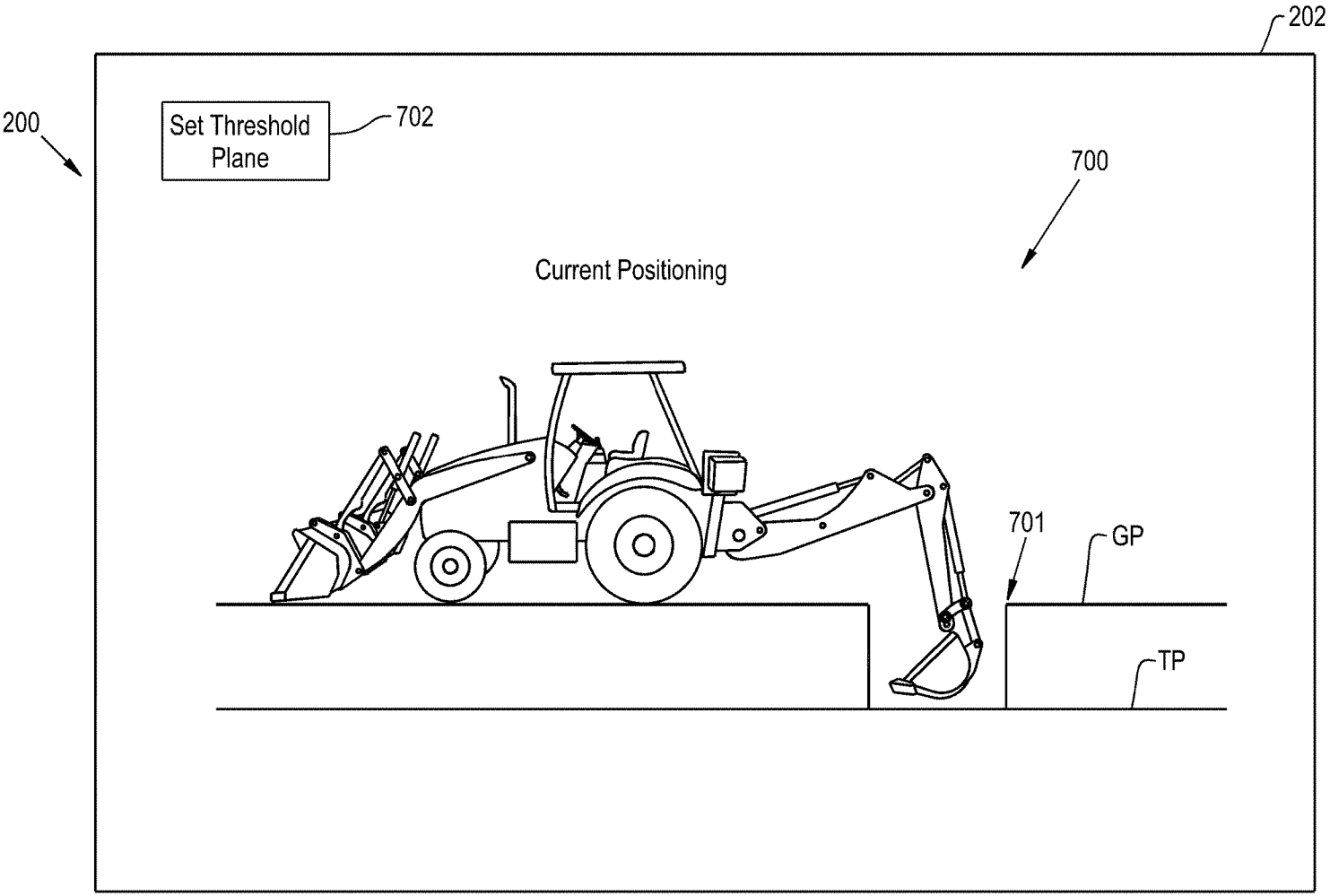
FIG. 7 is a view of an exemplary display showing a visualization of the work machine and a hole formed in a ground plane in accordance with an exemplary embodiment of the present invention.

In another exemplary embodiment formed in accordance with the present invention, and referring now to FIG. 7, a current visualization 700 which can be produced by the display 200 from signals output by the controller 140 is shown which take into account actions by the backhoe assembly 120 and desired operating parameters. As can be seen, the visualization shows the ground plane GP and a formed hole 701 produced in the ground plane GP by the bucket 125 removing material from the ground. The controller 140 can be configured, for example, to treat the ground plane GP as a first threshold plane which, when crossed by the bucket 125, indicates removal of material from the ground, and output an appropriate visualization update signal to the display 200 so the display 200 produces the visualization 700 which keeps track of the backhoe assembly 120 removing material. In one exemplary embodiment, the backhoe assembly 120 can include a load sensor 170 (shown in FIG. 1) coupled to the bucket 125 and the controller 140, with the controller 140 being configured to determine material has been removed from the ground at points below the ground plane GP where the load sensor 170 does not output signals corresponding to a significant load on the bucket 125. It should be appreciated that other ways of determining the backhoe assembly 120 has removed material from the hole 701 can also be utilized according to the present invention.

With further reference to FIG. 7, the controller 140 can also be configured to store a second threshold plane TP, shown as a threshold depth below the ground plane GP, in order to prevent the bucket 125 from entering areas that could damage the operator, work machine 100, or other surrounding structures. The threshold depth TP may, for example, correspond to a depth below which utility lines are located that could be damaged by the bucket 125 during a digging operation. The threshold depth TP can be stored in the controller 140, for example, by the operator selecting a plane set graphic 702 on the display 200 and placing the desired threshold plane TP on the current visualization 700. Alternatively, the operator can also input the desired threshold plane TP into the controller 140 as a numerical depth value, with the controller 140 outputting a threshold plane signal to the display 200 in order to visualize the threshold plane TP graphically.

Figure 8:
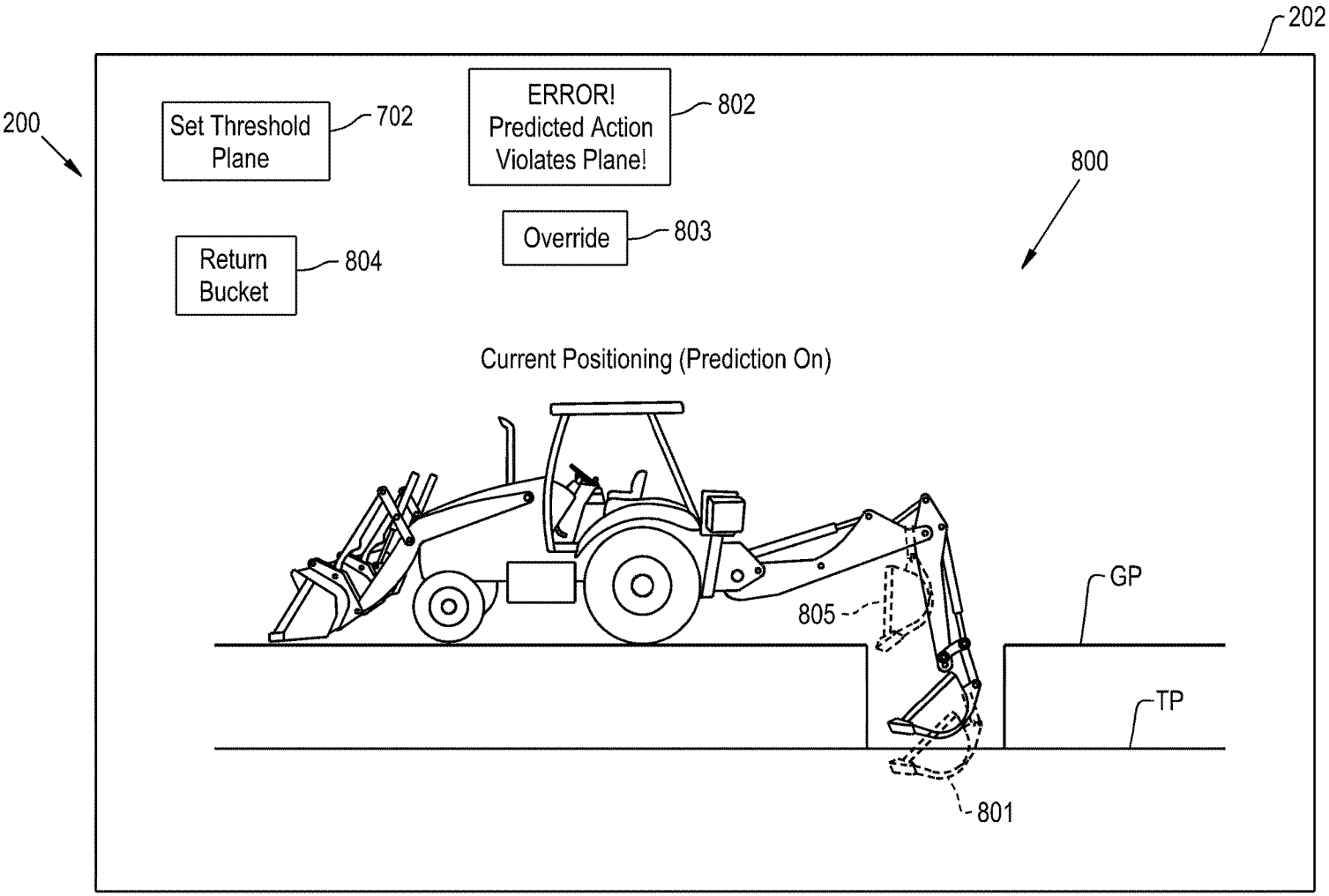
FIG. 8 is a view of an exemplary display showing a visualization of the work machine shown in FIG. 7 when a predicted location of the bucket crosses a threshold plane in accordance with an exemplary embodiment of the present invention.

Referring now to FIG. 8, a visualization 800 is shown on the display 200 in which a predicted bucket location 801 of the bucket 125, illustrated in dashed lines, determined by the controller 140 is shown as crossing the threshold plane TP. In such an instance, the controller 140 can be configured to prevent selective activation of one or more of the actuators 127, 128, 129, 132 which would cause the predicted bucket location 801 to occur in an attempt to prevent the bucket 125 from crossing the threshold plane TP. When the controller 140 does prevent selective activation to avoid the predicted bucket location 801 from crossing the threshold plane TP, the controller 140 can output an error signal to the display 200 so the display 200 shows an error message 802 on the screen 202 to inform the operator that the activation has not occurred. Optionally, the error signal can also cause the display 200 to show an override button 803 on the screen 202 which, upon activating, will send an override signal to the controller 140 to override the selective activation prevention and allow the controller 140 to selectively activate one or more of the actuators 127, 128, 129, 132 in a way that allows the bucket 125 to cross the threshold plane TP. In addition or alternatively, the error signal can also cause the display 200 to show a return button 804 which, upon activating, will send a return signal to the controller 140 to cause the controller 140 to selectively actuate one or more of the actuators 127, 128, 129, 132 to return the backhoe assembly 120 to a predetermined return position 805, also illustrated in dashed lines, without the bucket 125 crossing the threshold plane TP. It should be appreciated that the controller 140 can be configured to receive the return signal from the display 200 at any time during operation of the work machine 100, and a variety of other preset positions of the backhoe assembly 120 can be stored by the controller 140 and used by the controller 140 to automatically control one or more of the actuator(s) 127, 128, 129, 132 such that the backhoe assembly 120 is positioned to the selected preset position. It should be appreciated that a large variety of preset positions may be stored by the controller 140, and that the previously described preset positions are exemplary only.

Figure 9:
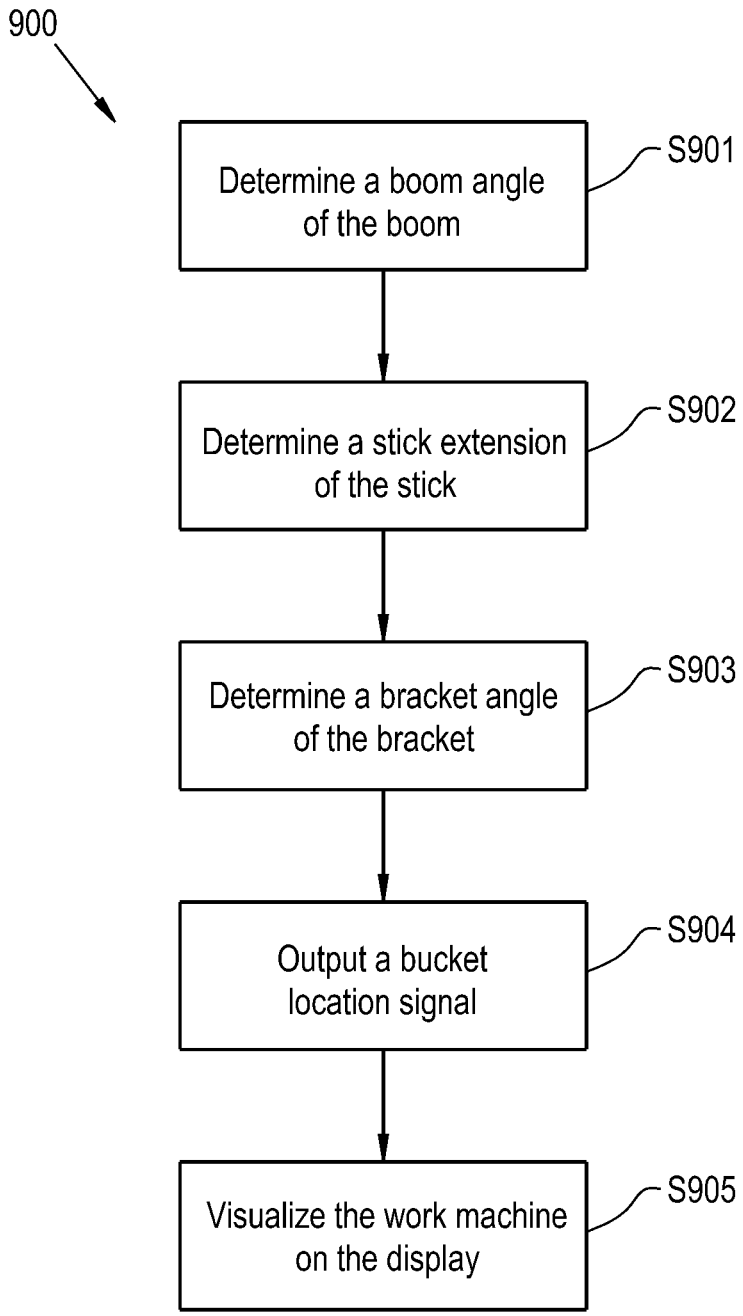
FIG. 9 is a flow chart showing a method in accordance with an exemplary embodiment of the present invention.

Referring now to FIG. 9, a flow chart showing an exemplary embodiment of a method 900 formed in accordance with the present invention is shown. The method 900 includes determining S901 the boom angle αBO of the boom 121 pivotably linked to the chassis 101, determining S902 the stick extension SL of the stick 123 extendably linked to the boom 121, determining S903 the bucket angle αBU of the bucket 125 pivotably linked to the stick 123, and outputting S904 the bucket location signal corresponding to the current bucket position 150 and current bucket orientation αCB, relative to the chassis 101, based on the determinations S901, 902, 903 of the boom angle αBO, stick extension SL, and bucket angle αBU. The method 900 can also include visualizing S905 the work machine 100 on the display 200 of the work machine 100 from, for example, the bucket location signal being output to the display 200, i.e., the bucket location signal can be a bucket visualization signal.

Figure 10:
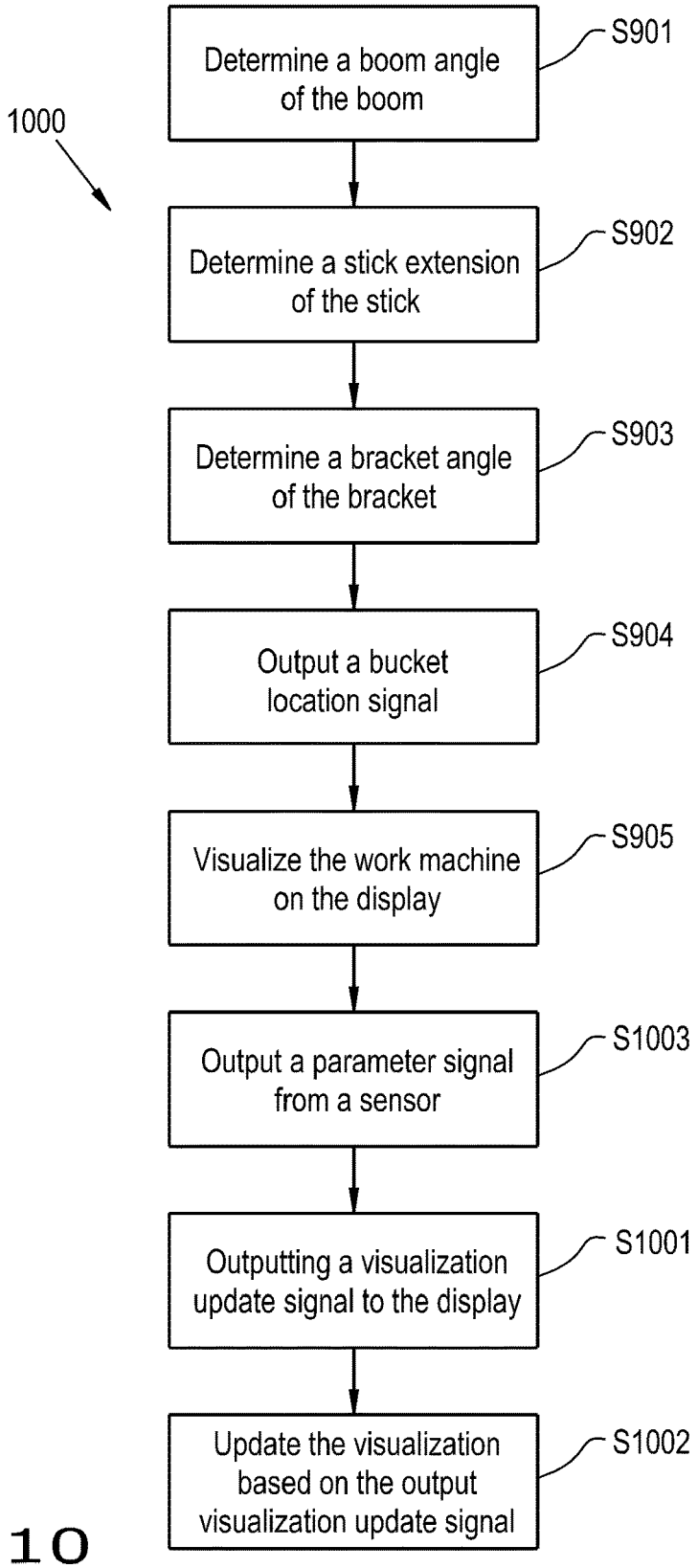
FIG. 10 is a flow chart showing a method in accordance with another exemplary embodiment of the present invention.

Referring now to FIG. 10, a flow chart showing another exemplary embodiment of a method 1000 formed in accordance with the present invention is shown. As can be seen, the method 1000 substantially includes the method 900 shown in FIG. 9 and further includes outputting S1001 a visualization update signal to the display 200 and updating S1002 the visualization S905 of the work machine 100 based on the output S1001 visualization update signal. The method 1000 may also include outputting S1003 one or more parameter signals from at least one additional sensor 410, 411, 412, with the output visualization update signal being based on the output S1003 parameter signal(s).

Figure 11:
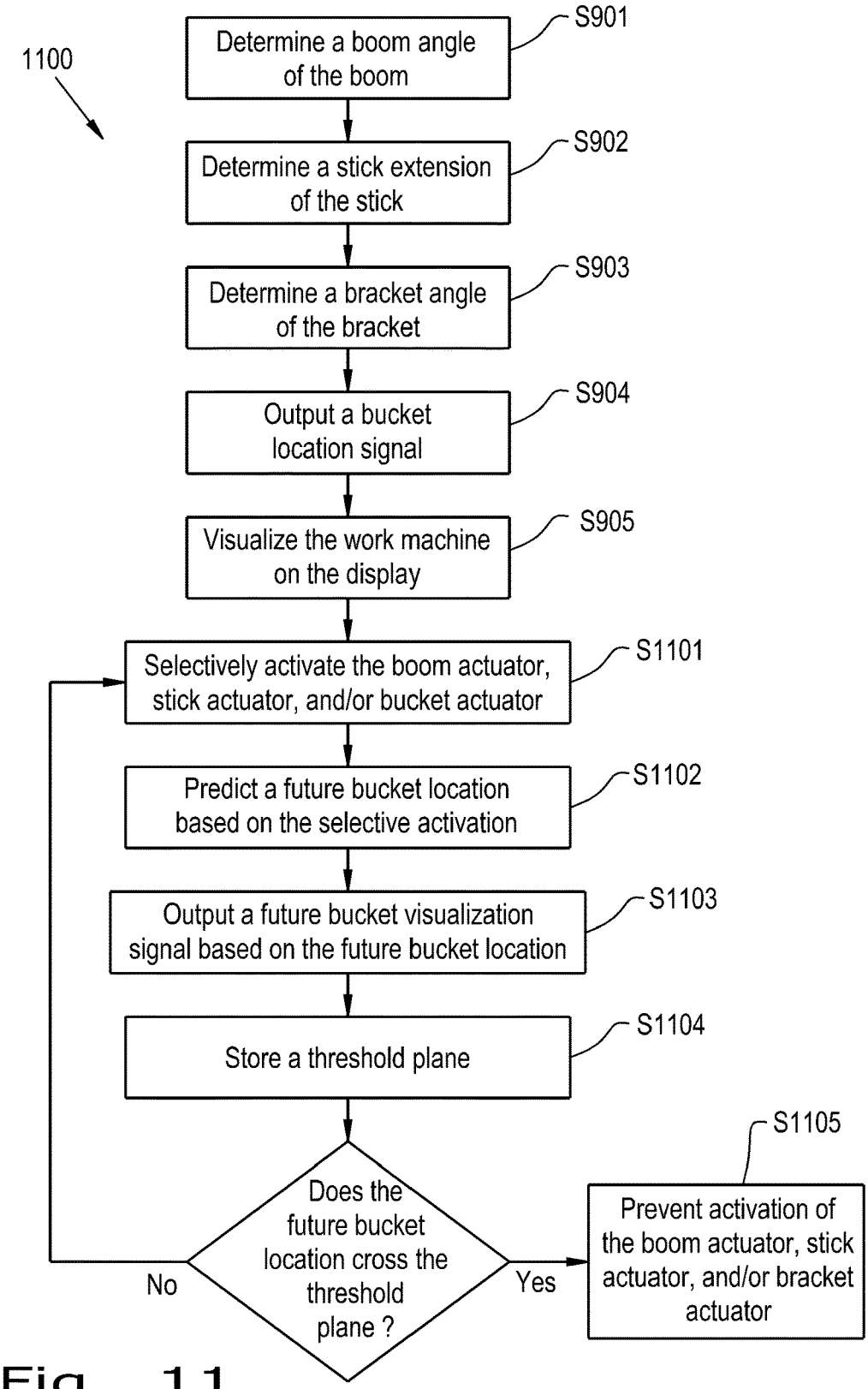
FIG. 11 is a flow chart showing a method in accordance with yet another exemplary embodiment of the present invention.

Referring now to FIG. 11, a flow chart showing yet another exemplary embodiment of a method 1100 formed in accordance with the present invention is shown. As can be seen, the method 1100 substantially includes the method 900 shown in FIG. 9 and further includes selectively activating S1101 the boom actuator 127, stick actuator 128, and/or bucket actuator 129; predicting S1102 a future bucket location 601 based on the selective activation S1101; and outputting S1103 a future bucket visualization signal based on the predicted future bucket location 601. The method 1100 can further include storing S1104 a threshold plane TP and preventing S1105 activation of the boom actuator 127, stick actuator 128, and/or bucket actuator 129 if the predicted future bucket position 601 crosses the threshold plane TP, which can be, for example, a threshold depth.

It is to be understood that the steps of the methods 900, 1000, and 1100 are performed by a respective controller 140 upon loading and executing software code or instructions which are tangibly stored on a tangible computer readable medium, such as on a magnetic medium, e.g., a computer hard drive, an optical medium, e.g., an optical disc, solid-state memory, e.g., flash memory, or other storage media known in the art. Thus, any of the functionality performed by the controller 140 described herein, such as the methods 900, 1000, and 1100, is implemented in software code or instructions which are tangibly stored on a tangible computer readable medium. Upon loading and executing such software code or instructions by the controller 140, the controller 140 may perform any of the functionality of the controller 140 described herein, including any steps of the methods 900, 1000, and 1100 described herein.

The term "software code" or "code" used herein refers to any instructions or set of instructions that influence the operation of a computer or controller. They may exist in a computer-executable form, such as machine code, which is the set of instructions and data directly executed by a computer's central processing unit or by a controller, a human-understandable form, such as source code, which may be compiled in order to be executed by a computer's central processing unit or by a controller, or an intermediate form, such as object code, which is produced by a compiler. As used herein, the term "software code" or "code" also includes any human-understandable computer instructions or set of instructions, e.g., a script, that may be executed on the fly with the aid of an interpreter executed by a computer's central processing unit, by a controller, or by a controller system.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A work machine, comprising:

a chassis;

a backhoe assembly carried by said chassis, said backhoe assembly comprising:

a boom pivotably linked to said chassis at a boom pivot point;

a boom angle sensor associated with said boom pivot point;

a stick extendably linked to said boom;

a stick extension sensor associated with said stick;

a bucket pivotably linked to said stick at a bucket pivot point; and a bucket angle sensor associated with said bucket pivot point;

a display configured to display a visualization of said work machine; and a controller coupled to said boom angle sensor, said stick extension sensor, said bucket angle sensor, and said display, said controller configured to:

determine a boom angle of said boom relative to said chassis;

determine a stick extension of said stick relative to said chassis;

determine a bucket angle of said bucket relative to said stick;

output a bucket location signal corresponding to a current bucket position and a current bucket orientation, relative to said chassis, based on said determined boom angle, stick extension, and bucket angle; and output a visualization update signal to said display, said display being configured to update said visualization of said work machine based on said visualization update signal.

2. The work machine according to claim 1, wherein said bucket location signal is a bucket visualization signal output to said display by said controller.

3. The work machine according to claim 1, further comprising at least one additional sensor coupled to said controller and configured to output a parameter signal to said controller, said controller being configured to output said visualization update signal based on said parameter signal.

4. The work machine according to claim 3, wherein said at least one additional sensor is at least one of a machine tilt sensor and a backhoe assembly sideshift sensor.

5. A work machine, comprising:

a chassis;

a backhoe assembly carried by said chassis, said backhoe assembly comprising:

a boom pivotably linked to said chassis at a boom pivot point;

a boom angle sensor associated with said boom pivot point;

a stick extendably linked to said boom;

a stick extension sensor associated with said stick;

a bucket pivotably linked to said stick at a bucket pivot point;

a bucket angle sensor associated with said bucket pivot point;

a boom actuator linked to said boom;

a stick actuator linked to said stick; and a bucket actuator linked to said bucket; and a controller coupled to said boom angle sensor, said stick extension sensor, and said bucket angle sensor, said controller configured to:

determine a boom angle of said boom relative to said chassis;

determine a stick extension of said stick relative to said chassis;

determine a bucket angle of said bucket relative to said stick;

output a bucket location signal corresponding to a current bucket position and a current bucket orientation, relative to said chassis, based on said determined boom angle, stick extension, and bucket angle;

selectively activate at least one of said boom actuator, said stick actuator, and said bucket actuator; and predict a future bucket location based on said selective activation of at least one of said boom actuator, said stick actuator, and said bucket actuator.

6. The work machine according to claim 5, wherein said controller is further configured to:

output a future bucket visualization signal based on said future bucket location.

7. The work machine according to claim 6, wherein said controller is configured to store a threshold plane and prevent activation of at least one of said boom actuator, said stick actuator, and said bucket actuator if said predicted future bucket location crosses said threshold plane.

8. The work machine according to claim 7, wherein said threshold plane is a threshold depth.

9. A method of locating a bucket of a work machine including a chassis, comprising:

determining a boom angle of a boom pivotably linked to said chassis, relative to said chassis, at a boom pivot point based on at least one signal from a boom angle sensor associated with said boom pivot point;

determining a stick extension of a stick extendably linked to said boom, relative to said chassis, based on at least one signal from a stick extension sensor associated with said stick;

determining a bucket angle of said bucket pivotably linked to said stick, relative to said stick, at a bucket pivot point based on at least one signal from a bucket angle sensor associated with said bucket pivot point;

outputting a bucket location signal corresponding to a current bucket position and a current bucket orientation, relative to said chassis, based on said determined boom angle, stick extension, and bucket angle;

visualizing said work machine on a display of said work machine;

outputting a visualization update signal to said display; and updating said visualization of said work machine based on said output visualization update signal.

10. The method according to claim 9, wherein said bucket location signal is a bucket visualization signal output to said display.

11. The method according to claim 9, further comprising:

outputting at least one parameter signal from at least one additional sensor, wherein said output visualization update signal is based on said at least one parameter signal.

12. The method according to claim 11, wherein said at least one parameter signal is at least one of a machine tilt signal and a backhoe assembly sideshift signal.

13. A method of locating a bucket of a work machine including a chassis, comprising:

determining a boom angle of a boom pivotably linked to said chassis, relative to said chassis, at a boom pivot point based on at least one signal from a boom angle sensor associated with said boom pivot point;

determining a stick extension of a stick extendably linked to said boom, relative to said chassis, based on at least one signal from a stick extension sensor associated with said stick;

determining a bucket angle of said bucket pivotably linked to said stick, relative to said stick, at a bucket pivot point based on at least one signal from a bucket angle sensor associated with said bucket pivot point;

outputting a bucket location signal corresponding to a current bucket position and a current bucket orientation, relative to said chassis, based on said determined boom angle, stick extension, and bucket angle;

selectively activating at least one of a boom actuator linked to said boom, a stick actuator linked to said stick, and a bucket actuator linked to said bucket; and predicting a future bucket location based on said selective activation.

14. The method according to claim 13, further comprising:

outputting a future bucket visualization signal based on said predicted future bucket location.

15. The method according to claim 14, further comprising:

storing a threshold plane; and preventing activation of at least one of said boom actuator, said stick actuator, and said bucket actuator if said predicted future bucket location crosses said threshold plane.

16. The method according to claim 15, wherein said threshold plane is a threshold depth.

* * * * *